United States Patent [19]

Elward

[11] 4,328,891

[45] May 11, 1982

[54] TAB SEPARATOR ELEMENT

[75] Inventor: John R. Elward, Novato, Calif.

[73] Assignee: Pacific Paperboard Products, Inc., San Francisco, Calif.

[21] Appl. No.: 157,798

[22] Filed: Jun. 9, 1980

[51] Int. Cl.[3] ..... B65D 75/04

[52] U.S. Cl. ..... 206/158; 229/40; 206/147; 206/427

[58] Field of Search ..... 206/427, 158, 153, 147; 229/23 C, 40; 294/87.2

[56] References Cited

U.S. PATENT DOCUMENTS

| | | | |
|---|---|---|---|
| 3,090,520 | 5/1963 | Wuerthner | 220/112 |
| 3,152,688 | 10/1964 | Mahon | 206/158 |
| 3,176,902 | 4/1965 | Champlin | 229/40 |
| 3,337,043 | 8/1967 | Parker | 206/193 X |
| 4,029,204 | 6/1977 | Manizza | 206/140 |
| 4,131,230 | 12/1978 | Koehlinger et al. | 206/158 X |
| 4,186,867 | 2/1980 | Wood | 229/40 |
| 4,234,081 | 11/1980 | Champlin | 206/147 |

*Primary Examiner*—Steven M. Pollard
*Attorney, Agent, or Firm*—Robert G. Slick

[57] ABSTRACT

An improved tab separator element interposes label bearing glass bottles in a paperboard carrier carton. An arcuately shaped fold line not only flares outwardly the front portion of the tab to provide a wider aperture facilitating insertion of the bottle into the carton, but also increases tab resiliency which aids in holding packaged bottles firmly in place within the carton. Leading edges of the tab are rounded and angled to decrease the possibility of tearing or disfiguring paper labels.

5 Claims, 8 Drawing Figures

TAB SEPARATOR ELEMENT

BACKGROUND OF THE INVENTION

This invention relates to an improvement in the tab separator elements used to separate containers such as glass bottles packaged in paperboard carrier cartons. Tab separator elements physically interpose the bottles to reduce the possibility of breakage through direct glass-to-glass contact. They aid in holding the bottles securely in place when the carton is transported from one location to another, and they also keep bottles from falling out of the carton after it has been opened by the consumer. Various forms of prior art tab separator elements are described in Wuerthner U.S. Pat. Nos. 3,090,520, Champlin 3,176,902, Manizza 4,029,204 and Wood 4,186,867.

Tab separator elements are formed from cutout portions of the bottom wall of a paperboard carton. Before the bottler fills the carton, he bends the tabs along a fold line to a vertical orientation. The tabs are of sufficient height to extend between adjacent bottles, and pairs of tabs cooperate to prevent glass-to-glass contact and bottle breakage. The tabs also apply pressure to the base of the bottle to help hold the bottle securely in place inside the carton after it has been sealed.

In the prior art, the opening between a pair of tabs into which a bottle fit was the same width whether measured between the front, middle or rear sections of the tabs. Because the opening must be slightly less than the bottle diameter to insure a snug fit, a problem arises if the bottle to be packaged is not properly aligned with the opening. If there is misalignment, the bottle may strike a tab element in such a way that it fails to enter the carton. This problem is alievated in the present invention because front sections of the tabs flare outwardly creating a wider opening into which the bottle can fit.

A second problem one encounters with tabs of the prior art is that they eventually cease to hold bottles firmly in place inside the carton. The result of this is that quite often when a consumer opens the carton to remove a bottle, another bottle falls out and breaks. The problem stems from loss of resiliency attributable to fatigue of the paperboard material from which the tab is formed. The arcuately shaped fold line of the present invention maintains tab resiliency and insures that the tabs apply continuous pressure to the bottle base.

A third drawback of prior art tabs is that they often tear or disfigure a bottle's paper label. Bottlers usually apply labels to their products just before they pack the bottles into the carton, and in most cases the glue on the back of the label has not had sufficient time to dry. If a damp label snags on a tab separator element, it is easily torn or disfigured. Wood U.S. Pat. No. 4,186,867 describes a tab designed to reduce label tearing and disfigurement, but it does not completely overcome the problem. By rounding and angling the leading edges of the tabs, however, the present invention significantly reduces the incidence of label snagging.

It is an object of the present invention therefore to make packaging bottles into the carton easier and to reduce the incidence of bottles striking the separator tabs and failing to enter the carton.

A further object of the invention is to provide a more resilient tab designed to reduce fatigue of the paperboard carton material and thereby to better hold bottles securely in place within the carton.

Yet another object of the invention is to provide a tab separator element which overcomes the problem of disfiguring and tearing bottle labels.

SUMMARY OF THE INVENTION

In the present invention, the fold lines of the tab separator elements are arcuately shaped, and in a given row of tabs, alternate between curving to the left and to the right. The alternating curves cause the front sections of a pair of tabs to flare outwardly, thereby creating an opening wider at the front of the tabs than between the centers of the tabs. The wider opening facilitates insertion of the bottle and reduces the likelihood of carton mis-packing, yet the relatively narrower opening between the tab centers still insures the snug fit needed to hold the bottle firmly in place inside the carton.

When a bottle is loaded into the carton, it deforms the tab, forcing the center of the tab to bend outwardly. Because of the resiliency of the paperboard material, the tab tries to return to its undeformed shape and thereby creates pressure tending to hold the base of the bottle securely in place. After a time, physical fatigue will reduce the resiliency of the tab and permit the bottle to become loose in the carton. In the present invention, the arcuate fold line maintains the resiliency of the tab beyond the lifetime experienced by tabs of the prior art.

In the present invention, the outward flare of the front portions of adjacent pairs of tabs also makes it more difficult for a paper label to snag on a tab. Further, by rounding the edges of the tabs and by designing the tabs so their leading edges do not lie in a line parallel to the edge of the paper label, the present invention achieves a significant reduction in the number of torn or disfigured labels.

DESCRIPTION OF THE BEST MODE

Figure 1:
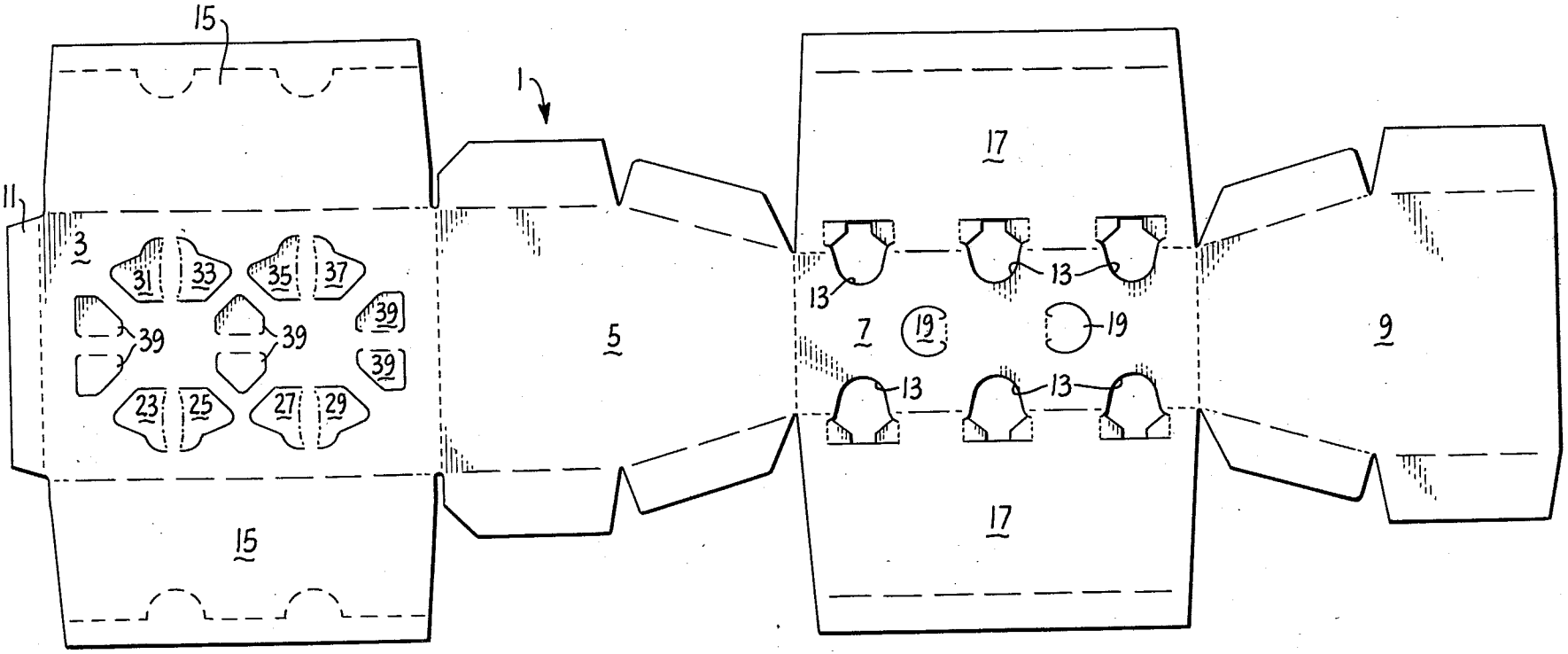
FIG. 1 is a plan view of a paperboard blank from which the bottle carrier is formed.
Figure 3:
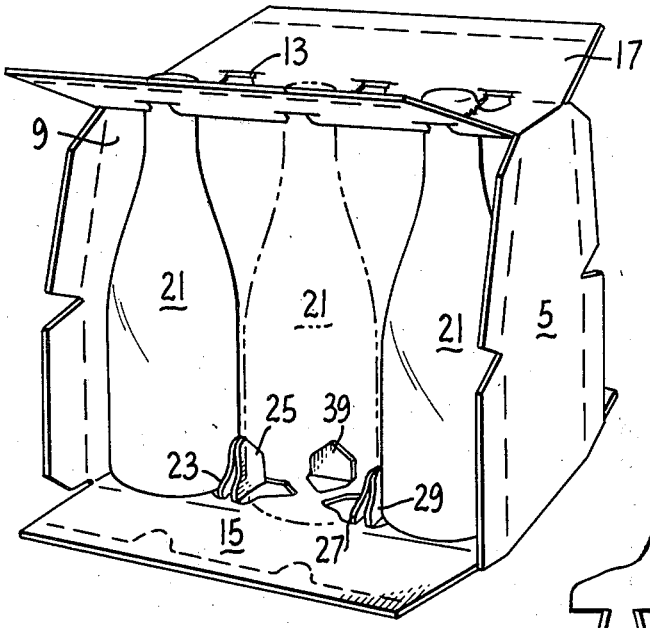
FIG. 3 illustrates use of tab separator elements within a carrier carton.
Figure 4:
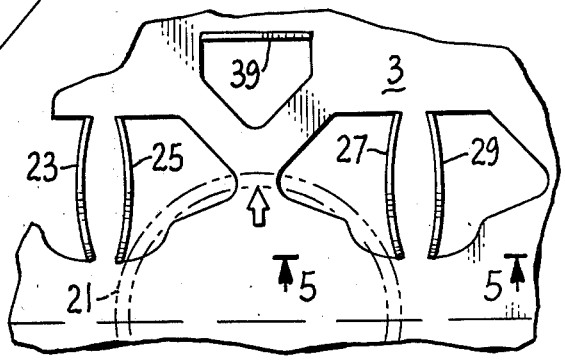
FIG. 4 illustrates a cooperating pair of tab separator elements and their spacing relative to the diameter of a bottle.

The carrier carton is fabricated from a paperboard blank 1 like that shown in FIG. 1. The blank has a bottom wall 3, a first end wall 5, a top wall 7 and a second end wall 9. The blank folds so that a flap section 11 attached to the bottom wall 3 can be glued to the end wall 9. As illustrated in FIG. 3, the bottles 21 are loaded into the carton through the open sides and their necks protrude through openings 13 cut in the top wall 7. The side walls of the carton are then formed by folding and gluing bottom flaps 15 to top flaps 17. The consumer carries the carton by inserting his fingers through two finger openings 19 cut in the top wall 7.

Figure 5:
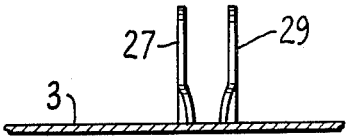
FIG. 5 is a side sectional view along axis 5—5 of FIG. 4 showing a pair of tab separator elements folded to their vertical orientation.
Figure 6:
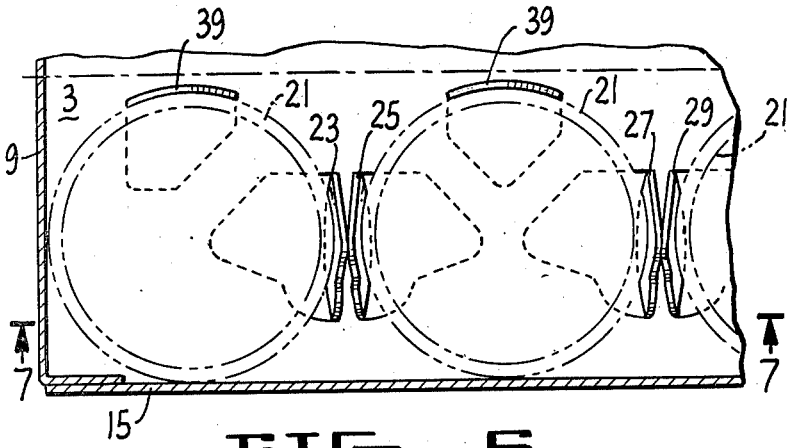
FIG. 6 is a horizontal cross-sectional view of two bottles packaged in the carrier carton of FIG. 3.

The blank shown in FIG. 1 is for a carton designed to accommodate six bottles. Before the bottles are loaded into the carton, the bottler folds the tab separator elements 23, 25, 27, 29, 31, 33, 35 and 37 to a vertical orientation best illustrated in FIG. 5. After the carton has been filled, pairs of tabs interpose the bottles in a row and cooperate to prevent glass to glass contact as illustrated in FIG. 6 and in FIG. 7. Pairs of central separator elements 39 cooperate in a manner analogous to the tabs to prevent glass-to-glass contact between bottles in one row with bottles in the other row.

Figure 2:
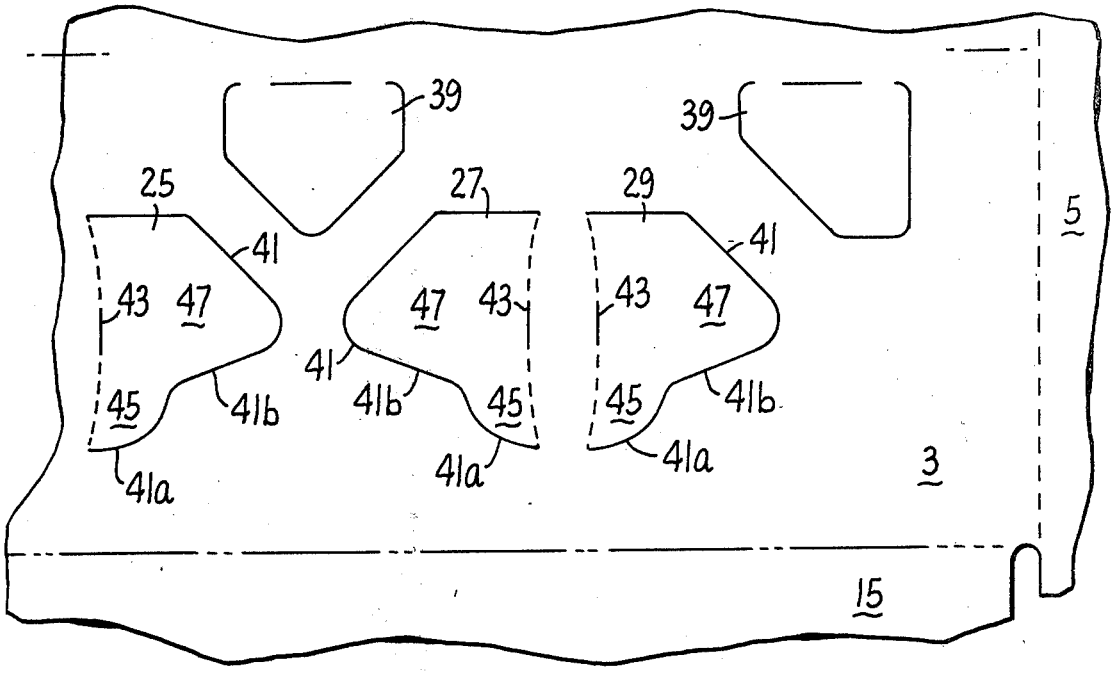
FIG. 2 is an enlarged view of a portion of the bottom wall of the blank of FIG. 1.

The tab separator elements are best seen in FIG. 2 which is an enlarged portion of the bottom wall 3 of the paperboard blank 1 of FIG. 1. The edge 41 of each tab is defined by a score line cut in the paperboard of bottom wall 3. The tabs fold to their vertical orientation along an arcuate fold line 43. As used herein, the term "arcuate" encompasses not only circular arcs, but also other shapes which approximate such arcs, as, for instance, a series of small, straight segments generally tangent to an imaginary arc. The direction of curvature of the fold line alternates from tab to tab. In FIG. 2, the fold line 43 of tab 25 curves to the left, the fold line of tab 27 curves to the right, and that of tab 29 to the left.

Each tab consists of a relatively small front section 45 and a relatively larger rear section 47. The front section 45 is the first part of the tab to make contact with an oncoming bottle, and serves to guide the bottle into the proper opening in the carton. The arcuate fold lines 43 and their alternating directions of curvature cause the tab front sections 45 to flare outwardly relative to the direction of motion of the oncoming bottle, thereby making the opening between a pair of tabs wider when measured between the front sections 45 than when measured between the centers of rear sections 47. This extra width facilitates insertion of the bottle into the carton and reduces the incidence of misloading.

Figure 7:
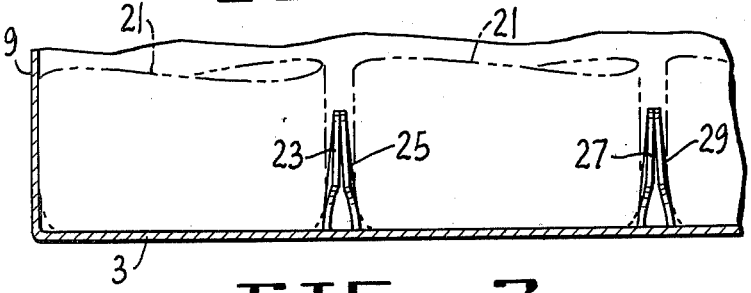
FIG. 7 is a vertical sectional view along axis 7—7 of FIG. 6.

Referring now to FIG. 6 and to FIG. 7, one can see that the diameter of the bottle 21 is slightly greater than the spacing between the centers of a pair of tabs, such as tabs 25 and 27, or between the center of a tab 23 and the carton end wall 9. However, there is enough flexibility in the paperboard material that the tabs simply bend around the bottle as it moves to its proper location within the carton. The bent tab, trying to return to its undeformed shape, exerts pressure upon the base of the bottle and snugly and securely holds the bottle in place inside the carton.

The slight bow imparted to the tab's forward section 45 and rear section 47 by the arcuate fold line 43 assists the tab in trying to return to its undeformed shape. Without this bow, fatigue of the deformed paperboard material occurs more rapidly and the tab will lose its resiliency and its consequent ability to firmly hold the base of the bottle.

Figure 8:
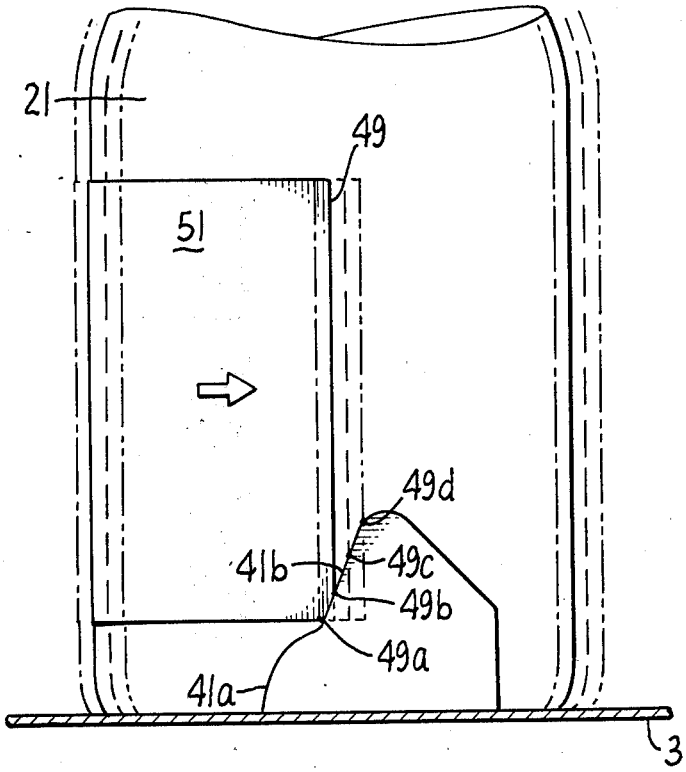
FIG. 8 is a side view of a label bearing bottle and a tab separator element showing with ghost lines the bottle and its label passing the tab during carton loading.

With reference now to FIG. 2 and to FIG. 8, the edge 41*a* of tab front section 45 and the leading edge 41*b* of tab rear section 47 both are designed with no portions parallel to the leading edge 49 of the bottle label 51. In most instances, this means that no portion of edge 41*a* or edge 41*b* will be perpendicular to the carton bottom wall 3 because usually the edge 49 of the label 51 lies in that plane. However, if the label has an unusual shape or is affixed to the bottle with its leading edge 49 at an angle relative to the bottom wall 3, the shape of the edges 41*a* and 41*b* should be modified accordingly.

Although numerous other geometries could be used, in the best mode embodiment, the edge 41*a* forms a circular arc of small radius and the edge 41*b* is angled rearwardly toward the center of the carton. As FIG. 8 illustrates, elimination of parallelism between tab edges 41*a* and 41*b* and the label edge 49 insures that at any instant in time the label edge makes contact with the edge of the tab at no more than a single point. In FIG. 8, that point of contact is, successively, point 49*a*, 49*b*, 49*c* and then 49*d* as the bottle 21 and label 51 move past the tab. Because snagging of the label is most likely to occur as the leading edge 49 of the label passes an edge 41 of the tab separator element, limiting contact between these two edges to a single point significantly reduces the incidence of snagging and the associated label tearing and disfigurement.

Although the invention has been described with a certain degree of particularity, it is understood that the present disclosure has been made only by way of example and that many modifications and changes in various details may be resorted to without departing from the spirit and scope of the invention, as hereinafter claimed.

I claim:

1. In a side loading container carrier having a bottom wall and arranged for loading at least two label bearing containers, improved tab separator elements formed from said bottom wall said tab separator elements being employed in pairs with a container between said pair of tabs, comprising a front section;

a rear section of sufficient height to interpose said label bearing containers, with neither said front section nor said rear section having a leading edge with any portion parallel to the leading edge of said label; and an arcuate fold line along which said front section and said rear section are joined to said bottom wall, said fold line being convex with respect to a container between said pair of tabs.

2. The tab separator element of claim 1 in which the front section flares outwardly relative to the direction of motion of the label bearing container being loaded.

3. The tab separator element of claim 2 in which the front section has an arcuately shaped scored edge.

4. The tab separator element of claim 3 in which the arcuately shaped scored edge is an arc of small radius.

5. The tab separator element of claim 3 in which the leading edge of said rear section is angled rearwardly toward the center of the carton.

* * * * *